US009669246B2

(12) United States Patent
Bowen et al.

(10) Patent No.: US 9,669,246 B2
(45) Date of Patent: Jun. 6, 2017

(54) AQUEOUS FIRE-FIGHTING FOAMS WITH REDUCED FLUORINE CONTENT

(75) Inventors: Martina E. Bowen, Marinette, WI (US); Yuan Xie, Marinette, WI (US); Pamela A. Havelka-Rivard, Wallace, MI (US)

(73) Assignee: Tyco Fire Products LP, Lansdale, PA (US)

( * ) Notice: Subject to any disclaimer, the term of this patent is extended or adjusted under 35 U.S.C. 154(b) by 873 days.

(21) Appl. No.: 13/876,460

(22) PCT Filed: Oct. 3, 2011

(86) PCT No.: PCT/US2011/054628

§ 371 (c)(1),
(2), (4) Date: Jun. 25, 2013

(87) PCT Pub. No.: WO2012/045080

PCT Pub. Date: Apr. 5, 2012

(65) Prior Publication Data

US 2013/0277597 A1 Oct. 24, 2013

Related U.S. Application Data

(60) Provisional application No. 61/389,027, filed on Oct. 1, 2010.

(51) Int. Cl.
*A62D 1/02* (2006.01)

(52) U.S. Cl.
CPC ..... *A62D 1/0085* (2013.01); *A62D 1/0071* (2013.01)

(58) Field of Classification Search
None
See application file for complete search history.

(56) References Cited

U.S. PATENT DOCUMENTS

| | | | | |
|---|---|---|---|---|
| 3,047,619 | A | 7/1962 | Brace | |
| 3,257,407 | A | 6/1966 | Brace | |
| 3,258,423 | A | 6/1966 | Tuve et al. | |
| 3,562,156 | A | 2/1971 | Francen | |
| 3,621,059 | A | 11/1971 | Bartlett | |
| 3,655,555 | A | 4/1972 | Rossmy et al. | |
| 3,661,776 | A | 5/1972 | Fletcher et al. | |
| 3,677,347 | A | 7/1972 | Rosen et al. | |
| 3,759,981 | A | 9/1973 | Hager et al. | |
| 3,772,199 | A | 11/1973 | Tamai et al. | |
| 3,789,265 | A | 1/1974 | Holz et al. | |
| 3,828,085 | A | 8/1974 | Fenster et al. | |
| 3,839,425 | A | 10/1974 | Bartlett | |
| 3,941,708 | A | 3/1976 | Gentit et al. | |
| 3,952,075 | A | 4/1976 | Nakamura et al. | |
| 3,957,657 | A | 5/1976 | Chiesa, Jr. et al. | |
| 3,957,658 | A | 5/1976 | Chiesa, Jr. et al. | |
| 3,963,776 | A | 6/1976 | Middleton et al. | |
| 4,038,198 | A | 7/1977 | Wagner et al. | |
| 4,042,522 | A | 8/1977 | Falk et al. | |
| 4,049,556 | A | 9/1977 | Tujimoto et al. | |
| 4,060,132 | A | 11/1977 | Chiesa, Jr. et al. | |
| 4,060,489 | A | 11/1977 | Chiesa, Jr. et al. | |
| 4,069,158 | A | 1/1978 | Foulletier et al. | |
| 4,090,976 | A | 5/1978 | DeHollander et al. | |
| 4,098,811 | A | 7/1978 | Falk et al. | |
| 4,099,574 | A | 7/1978 | Cooper et al. | |
| 4,149,599 | A | 4/1979 | Chiesa, Jr. et al. | |
| 4,203,850 | A | 5/1980 | Wirtz et al. | |
| 4,209,407 | A | 6/1980 | Schuierer et al. | |
| 4,387,032 | A | 6/1983 | Chiesa, Jr. et al. | |
| 4,536,298 | A | 8/1985 | Kamei et al. | |
| 4,999,119 | A | 3/1991 | Norman et al. | |
| 5,218,021 | A | 6/1993 | Clark et al. | |
| 5,391,721 | A | 2/1995 | Hanen et al. | |
| 5,616,273 | A * | 4/1997 | Clark | A62D 1/0085 252/2 |
| 5,688,884 | A | 11/1997 | Baker et al. | |
| 2001/0001478 | A1 | 5/2001 | Dams et al. | |
| 2016/0023032 | A1* | 1/2016 | Bowen | A62D 1/0035 169/47 |
| 2016/0030793 | A1* | 2/2016 | Xie | A62D 1/0071 106/14.42 |

FOREIGN PATENT DOCUMENTS

| | | | |
|---|---|---|---|
| DE | 195 19 534 | A1 | 11/1996 |
| EP | 0 049 958 | A2 | 4/1982 |
| EP | 0 621 057 | A1 | 10/1994 |
| EP | 0 755 701 | A1 | 1/1997 |
| WO | 91/01160 | A1 | 2/1991 |
| WO | WO 01/30873 | A1 | 5/2001 |
| WO | WO 03/049813 | A1 | 6/2003 |

OTHER PUBLICATIONS

Supplementary European Search Report, European Application No. 11 83 0065, Feb. 26, 2014 (5 pages).
International Search Report for PCT/US2011/054628 (Form PCT/ISA/210), Feb. 29, 2012, 3 pages.
Written Opinion of the International Searching Authority for PCT/US2011/054628 (Form PCT/ISA/237), Feb. 29, 2012, 5 pages.
U.S. Appl. No. 61/389,027, filed Oct. 1, 2010, Parent Application to U.S. Appl. No. 13/876,460.

* cited by examiner

*Primary Examiner* — Joseph D Anthony
(74) *Attorney, Agent, or Firm* — Perkins Coie LLP

(57) ABSTRACT

Aqueous film forming firefighting composition concentrates are provided that contain an effective amount of a monomelic zwitterionic or anionic $C_6$ perfluoroalkyl surfactant having a molecule weight less than 800 daltons. The compositions also contain an effective amount of a foam stabilizing agent, and an effective amount of at least one non-fluorinated surfactant. The composition has less than 0.8% F, and is substantially free of any surfactant containing a perfluoroalkyl group containing more than 6 carbon atoms. The composition meets Military Specification MIL-F-24385F.

25 Claims, No Drawings

AQUEOUS FIRE-FIGHTING FOAMS WITH REDUCED FLUORINE CONTENT

PRIORITY DATA AND INCORPORATION BY REFERENCE

This international application claims the benefit of priority to U.S. Provisional Patent Application No. 61/389,027, filed Oct. 1, 2010, entitled "Aqueous Fire-Fighting Foams With Reduced Fluorine Content", the contents of which is hereby incorporated by reference in its entirety.

BACKGROUND

Firefighting foam concentrates contain mixtures of surfactants that act as foaming agents, together with solvents and other additives that provide the desired mechanical and chemical properties for the foam. The concentrates are mixed with water in situ and foamed by mechanical means, and the resulting foam is projected onto the fire, typically onto the surface of a burning liquid. The concentrates are typically used at a concentration of about 1-6%.

Aqueous film-forming foam (AFFF) concentrates are designed to spread an aqueous film on the surface of hydrocarbon liquids, which increases the rate at which the fire can be extinguished. This spreading property is made possible by the use of perfluoroalkyl surfactants in AFFF, which produce very low surface tension values in solution (15-20 dynes $cm^{-1}$), thereby permitting the aqueous solution to spread on the surface of the hydrocarbon liquids.

However, typical AFFF foams are not effective on fires caused by water-miscible fuels, such as low molecular weight alcohols, ketones, and esters and the like, because the miscibility of the solvent leads to dissolution and destruction of the foam by the fuel. To address this issue, alcohol resistant AFFF (ARAFFF) concentrates are used, which contain a water-soluble polymer that precipitates on contact with a water-miscible fuel, creating a protective layer between the fuel and the foam. Typical water-soluble polymers used in ARAFFF are polysaccharides, such as xanthan gums. ARAFFF foams are effective on both hydrocarbon and water-soluble fuels.

Conventional AFFF concentrates contain mixtures of perfluoroalkyl and non-fluorinated surfactants, each of which may be anionic, cationic, nonionic or amphoteric, solvents such as glycols and/or glycol ethers, and minor additives such as chelating agents, pH buffers, corrosion inhibitors and the like. Various AFFF concentrates are described in, for example, U.S. Pat. Nos. 3,047,619; 3,257,407; 3,258,423; 3,562,156; 3,621,059; 3,655,555; 3,661,776; 3,677,347; 3,759,981; 3,772,199; 3,789,265; 3,828,085; 3,839,425; 3,849,315; 3,941,708; 3,95,075; 3,957,657; 3,957,658; 3,963,776; 4,038,198; 4,042,522; 4,049,556; 4,060,132; 4,060,489; 4,069,158; 4,090,976; 4,099,574; 4,149,599; 4,203,850; and 4,209,407. ARAFFF concentrates are described in, for example, U.S. Pat. No. 4,060,489; U.S. Pat. No. 4,149,599 and U.S. Pat. No. 4,387,032.

BRIEF SUMMARY

Aqueous film forming firefighting composition concentrates are provided that contain an effective amount of a perfluoroalkyl surfactant, an effective amount of a foam stabilizing agent, and an effective amount of at least one non-fluorinated surfactant. The perfluoroalkyl surfactant is a monomeric zwitterionic or anionic $C_6$ perfluoroalkyl surfactant having a molecule weight less than 800 daltons. The composition has less than 0.8% F, and is substantially free of any surfactant containing a perfluoroalkyl group containing more than 6 carbon atoms. The composition meets Military Specification MIL-F-24385F.

The perfluoroalkyl surfactant may have a structure represented by the formula I:

$$R_f—X—Y-L-Z \qquad \text{I:}$$

where $R_f$ is a $C_6$ straight or branched chain perfluoroalkyl;

X is a $C_2$-$C_{12}$ straight or branched chain alkylene, or a $C_2$-$C_{12}$ straight or branched chain alkenylene containing 1 or 2 alkene moieties;

Y is —S—$CH_2CH(R^1)CON(R^2)$—, —O—$CH_2CH_2$—$N(R^3)(R^4)$—; —O—$CH_2CH(OR^5)CH_2$—$N(R^3)(R^4)$—; —O—$CH_2CH(OR^5)CH_2$—S—; —S—$CH_2CH(OR^5)CH_2$—$N(R^3)(R^4)$—; or —S—$CH_2CH(OR^5)CH_2$—S—;

L is $C_2$-$C_{12}$ straight or branched chain alkylene, where one carbon atom in the chain optionally may be replaced by —$N(R^6)(R^7)$—; and Z is —$OSO_3^-$, —$SO_3^-$, or —$CO_2^-$, where $R^1$, $R^2$, $R^3$, $R^4$, $R^6$ and $R^7$, independently may be H or straight or branched chain $C_1$-$C_6$ alkyl, and $R^5$ may be H or straight or branched chain $C_1$-$C_6$ alkyl or trialkylsilyl. Advantageously, the composition does not contain an effective amount of a perfluorinated surfactant that does not conform to formula I, although in certain embodiments, the composition may contain an effective amount of a fluorinated foam stabilizing agent containing 3 to 7 perfluorinated carbon atoms.

In specific embodiments of the composition, Y may be —S—$CH_2C(R^1)CON(R^2)$—, for example where $R^1$ may be H or straight chain alkyl and $R^2$ may be H. In further embodiments, Y may be —O—$CH_2CH_2$—$N(R^3)(R^4)$— where, for example, $R^3$ and $R^4$ are H or methyl. In still further embodiments, Y may be —O—$CH_2CH(OR^5)CH_2$—$N(R^3)(R^4)$— where, for example, $R^3$ and $R^4$ may be H or methyl, and $R^5$ may be H or trialkylsilyl. In yet more embodiments, Y may be —O—$CH_2CH(OR^5)CH_2$—S—, where, for example, $R^5$ may be H or trialkylsilyl. In other embodiments, Y may be —S—$CH_2CH(OR^5)CH_2$—$N(R^3)(R^4)$—, where, for example; $R^3$ and $R^4$ may be H or methyl, and $R^5$ may be H or trialkylsilyl. In still other embodiments, Y may be —S—$CH_2CH(OR^5)CH_2$—S—, where $R^5$ may be H or trialkylsilyl.

In any of these embodiments, more than one perfluoroalkyl surfactants of formula I may be used.

In particular embodiments of the concentrate, the non-fluorinated surfactant may be an anionic surfactant and/or the foam stabilizing agent may be a glycol ether. In addition, the composition may contain a corrosion inhibitor.

In any of these embodiments, the composition may also contain an alkylpolyglycoside, typically in an amount of about 0.3 to about 7%. In further embodiments, the composition may also contain a polysaccharide gum, typically in an amount of about 0.1 to about 5%.

In a specific embodiment of the composition, the foam stabilizing agent is present in an amount of 1-50%, the non-fluorinated surfactant is present in an amount of 0.1 to 30% and the perfluoroalkyl surfactant or mixture of surfactants of formula I is present in an amount of 0.5 to 20%.

Also provided are fire-fighting foams, containing a composition as described above, and water or an aqueous liquid. In specific embodiments, the aqueous liquid may be brackish water or seawater.

The compositions as described above may be used in methods of making a fire-fighting foam, where the composition is foamed with water or an aqueous liquid. In specific embodiments, the aqueous liquid may be brackish water or seawater.

DETAILED DESCRIPTION

Until recently, aqueous film forming foams that were used for fire fighting invariably contained surfactants having perfluoroalkyl chains where the perfluoroalkyl group was at least a perfluorooctyl group. It was believed that a surfactant required at least a perfluorooctyl moiety to provide the necessary physicochemical attributes for efficient and persistent foam formation for fire fighting applications. See WO03/049813. However, perfluorooctyl moieties have been shown to be environmentally persistent and to accumulate in the livers of test animals, leading to calls for the phase-out of materials containing a perfluorooctyl group. Recent regulatory efforts such as the United States EPA Stewardship Program and EC directives pertaining to telomere-based higher homologue perfluorinated surfactants have sought to discourage use of perfluorooctyl-containing surfactants. In response, various surfactants have been developed containing perfluorohexyl (commonly referred to as "C6") moieties which are less persistent in the environment, and which also do not seem to bioaccumulate in the same manner. See U.S. Pat. No. 5,688,884.

Although C6 fluorosurfactants have been reported to be satisfactory for less demanding applications, such as cleaning solutions, the reduction in length of the perfluoroalkyl chain unfortunately leads to a decrease in the ability to form long lasting persistent foams with the properties necessary for effective fire fighting. Thus, AFFF and ARFFF concentrates where the perfluorooctyl surfactant is replaced by an equivalent C6 compound are unable to meet the requirements of the US and international standards for fire fighting applications.

To counter this loss of activity, manufacturers have been forced to increase the concentration of fluorosurfactant in AFFF concentrates and/or to use oligomeric surfactants in which multiple perfluoroalkyl groups are covalently attached to short polymeric carrier molecules. See WO01/030873. In both instances the total concentration of fluorine atoms (calculated on a weight percentage basis) remains at an undesirably high level.

Unfortunately, until the present time it has not been possible to prepare compositions containing perfluoroalkyl groups that are shorter than perfluorooctyl yet still retain the necessary properties to allow preparation of effective AFFF at the "industrial standard" of fluorine levels. Unexpectedly, it has now been found that certain fluorosurfactants containing $C_6$ perfluoro moieties can be prepared that can be used to replace $C_8$ perfluoro moieties in allowing the preparation of AFFF. Moreover, even more unexpectedly, these fluorosurfactants can be used to prepare AFFF concentrates that are still effective even when foamed with water containing a high salt content, e.g. seawater or brackish water.

The $C_6$ fluorosurfactants that provide these highly desirable and heretofore unattainable properties are monomeric, which in the present context shall be understood to refer to molecules having a single clearly defined structure, as opposed to multimeric surfactant compositions where perfluoroalkyl-containing moieties are covalently linked to oligomeric or polymeric carrier molecules. Such multimeric compositions contain surfactants with a range of molecular weights and a corresponding variety of molecular structures and compositions. Moreover, most conventional perfluorosurfactants contain mixtures of different chain lengths (typically $C_2$, $C_4$, $C_6$, $C_8$ etc.) as a result of the telomerization process used in their preparation. The present monomeric fluorinated surfactants are essentially free of perfluoroalkyl groups of other chain lengths. Thus, for example, a $C_6$ monomeric surfactant is essentially free of $C_2$, $C_3$, $C_4$, $C_5$, $C_7$, $C_8$, etc.

The monomeric $C_6$ fluorosurfactants advantageously have a molecular weight of less than 800 Daltons, which further distinguishes them from the multimeric compositions described above. Moreover, when the monomeric $C_6$ fluorosurfactants are formulated with an effective amount of a foam stabilizing agent, for example, a glycol ether, and an effective amount of a non-fluorinated surfactant, the resulting concentrates meet the stringent requirements of US Military Specification MIL-F-24385F for fire fighting at a concentration where the final concentration of fluorine atoms on a weight percentage basis is less than 0.8%. This level of performance at low fluorine levels is unprecedented and can be achieved with a composition that is substantially free of any fluorosurfactant containing perfluorooctyl (or longer) chains. In the present context a composition is substantially free of a component when that component is present, if at all, at trace (impurity) levels that are too low to materially affect the properties of the composition. The $C_6$ fluorosurfactants can be zwitterionic or anionic.

The monomeric $C_6$ fluorosurfactants can be represented by the Formula I:

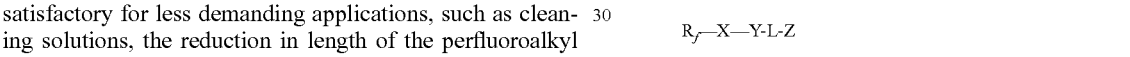

$$R_f—X—Y-L-Z \qquad \text{I:}$$

Where $R_f$ is a $C_6$ straight or branched chain perfluoroalkyl. X is a $C_2$-$C_{12}$ straight or branched chain alkylene, or a $C_2$-$C_{12}$ straight or branched chain alkenylene containing 1 or 2 alkene moieties, Y is $—S—CH_2CH(R^1)CON(R^2)—$, $—O—CH_2CH_2—N(R^3)(R^4)—$; $—O—CH_2CH(OR^5)CH_2—N(R^3)(R^4)—$; $—O—CH_2CH(OR^5)CH_2—S—$; $—S—CH_2CH(OR^5)CH_2—N(R^3)(R^4)—$; or $—S—CH_2CH(OR^5)CH_2—S—$;

L is $C_2$-$C_{12}$ straight or branched chain alkylene, where one carbon atom in the chain optionally may be replaced by $—N(R^6)(R^7)—$; and Z is $—OSO_3^-$, $—SO_3^-$, or $—CO_2^-$.

In the compounds of Formula I, each $R^1$, $R^2$, $R^3$, $R^4$, $R^6$ or $R^7$ independently may be H or straight or branched chain $C_1$-$C_6$ alkyl, and $R^5$ may be H or straight or branched chain $C_1$-$C_6$ alkyl or trialkylsilyl.

As used herein the term "alkyl group" or "alkyl" includes straight and branched carbon chain radicals. The term "alkylene" refers to a diradical of an unsubstituted or substituted alkane. For example, a "$C_{1-6}$ alkyl" is an alkyl group having from 1 to 6 carbon atoms. Examples of $C_1$-$C_6$ straight-chain alkyl groups include, but are not limited to, methyl, ethyl, n-propyl, n-butyl, n-pentyl, and n-hexyl. Examples of branched-chain alkyl groups include, but are not limited to, isopropyl, tert-butyl, isobutyl, etc. Examples of alkylene groups include, but are not limited to, $—CH_2—$, $—CH_2—CH_2—$, $—CH_2—CH(CH_3)—CH_2—$, and $—(CH_2)_3$. Alkyl groups can be substituted or unsubstituted, as indicated. Examples of substituted alkyl include haloalkyl, thioalkyl, aminoalkyl, and the like. Alkylene groups can be substituted or unsubstituted, as indicated.

Certain compounds as described herein may exist in multiple crystalline or amorphous forms (i.e., as polymorphs). In general, all physical forms are equivalent for the uses contemplated herein and are intended to be within the scope of the compositions and methods present described herein.

It will be apparent to one skilled in the art that certain compounds as described herein may also exist in tautomeric forms, and all such tautomeric forms of the compounds are within the scope of the compositions described herein. Similarly, to the extent that compounds described herein contain asymmetric carbon atoms (optical centers) or double bonds; the racemates, diastereomers, geometric isomers and individual isomers (e.g., separate enantiomers) are all intended to be encompassed within the scope of the compounds.

In specific embodiments of the compound of Formula I, Y may be —S—$CH_2C(R^1)CON(R^2)$—, for example where $R^1$ may be H or straight chain alkyl and $R^2$ may be H. Y may also be —O—$CH_2CH_2$—$N(R^3)(R^4)$— where, for example, $R^3$ and $R^4$ are H or methyl. In other embodiments, Y may be —O—$CH_2CH(OR^5)CH_2$—$N(R^3)(R^4)$— where, for example, $R^3$ and $R^4$ may be H or methyl, and $R^5$ may be H or trialkylsilyl. In still other embodiments, Y may be —O—$CH_2CH(OR^5)CH_2$—S—, where, for example, $R^5$ may be H or trialkylsilyl. In further embodiments, Y may be —S—$CH_2CH(OR^5)CH_2$—$N(R^3)(R^4)$—, where, for example; $R^3$ and $R^4$ may be H or methyl, and $R^5$ may be H or trialkylsilyl. In still other embodiments, Y may be —S—$CH_2CH(OR^5)CH_2$—S—, where $R^5$ may be H or trialkylsilyl.

The skilled artisan will recognize that the description of the surfactants by the formula $R_f$—X—Y-L-Z includes each of the possible combinations of $R_f$—X—Y-L-Z as though set forth separately, taking into account the valencies of each atom, unless otherwise specifically described. For example, the surfactants include compounds with the following combinations of elements:

| $R_f$ | X | Y | L | Z |
|---|---|---|---|---|
| n-$C_6F_{13}$ | $(CH_2)_2$ or —(CH=CH)—$CH_2$— | —S—$CH_2CH(R^1)CON(R^2)$— | $(CH_2)_{2-3}$ | —$OSO_3^-$ |
| n-$C_6F_{13}$ | $(CH_2)_2$ or —(CH=CH)—$CH_2$— | —O—$CH_2CH_2$—$N(R^3)(R^4)$— | $(CH_2)_{2-3}$ | —$OSO_3^-$ |
| n-$C_6F_{13}$ | $(CH_2)_2$ or —(CH=CH)—$CH_2$— | —O—$CH_2CH(OR^5)CH_2$—$N(R^3)(R^4)$— | $(CH_2)_{2-3}$ | —$OSO_3^-$ |
| n-$C_6F_{13}$ | $(CH_2)_2$ or —(CH=CH)—$CH_2$— | —O—$CH_2CH(OR^5)CH_2$—S— | $(CH_2)_{2-3}$ | —$OSO_3^-$ |
| n-$C_6F_{13}$ | $(CH_2)_2$ or —(CH=CH)—$CH_2$— | —S—$CH_2CH(OR^5)CH_2$—$N(R^3)(R^4)$— | $(CH_2)_{2-3}$ | —$OSO_3^-$ |
| n-$C_6F_{13}$ | $(CH_2)_2$ or —(CH=CH)—$CH_2$— | —S—$CH_2CH(OR^5)CH_2$—S— | $(CH_2)_{2-3}$ | —$OSO_3^-$ |
| n-$C_6F_{13}$ | $(CH_2)_2$ or —(CH=CH)—$CH_2$— | —S—$CH_2CH(R^1)(CON(R^2)$— | $(CH_2)_{2-3}$ | —$SO_3^-$ |
| n-$C_6F_{13}$ | $(CH_2)_2$ or —(CH=CH)—$CH_2$— | —O—$CH_2CH_2$—$N(R^3)(R^4)$— | $(CH_2)_{2-3}$ | —$SO_3$ |
| n-$C_6F_{13}$ | $(CH_2)_2$ or —(CH=CH)—$CH_2$— | —O—$CH_2CH(OR^5)CH_2$—$N(R^3)(R^4)$— | $(CH_2)_{2-3}$ | —$SO_3$ |
| n-$C_6F_{13}$ | $(CH_2)_2$ or —(CH=CH)—$CH_2$— | —O—$CH_2CH(OR^5)CH_2$—S— | $(CH_2)_{2-3}$ | —$SO_3$ |
| n-$C_6F_{13}$ | $(CH_2)_2$ or —(CH=CH)—$CH_2$— | —S—$CH_2CH(OR^5)CH_2$—$N(R^3)(R^4)$— | $(CH_2)_{2-3}$ | —$SO_3$ |
| n-$C_6F_{13}$ | $(CH_2)_2$ or —(CH=CH)—$CH_2$— | —S—$CH_2CH(OR^5)CH_2$—S— | $(CH_2)_{2-3}$ | —$SO_3$ |
| n-$C_6F_{13}$ | $(CH_2)_2$ or —(CH=CH)—$CH_2$— | —S—$CH_2CH(R^1)CON(R^2)$— | $(CH_2)_{1-3}$ | —$CO_2^-$ |
| n-$C_6F_{13}$ | $(CH_2)_2$ or —(CH=CH)—$CH_2$— | —O—$CH_2CH_2$—$N(R^3)(R^4)$— | $(CH_2)_{1-3}$ | —$CO_2$ |
| n-$C_6F_{13}$ | $(CH_2)_2$ or —(CH=CH)—$CH_2$— | —O—$CH_2CH(OR^5)CH_2$—$N(R^3)(R^4)$— | $(CH_2)_{1-3}$ | —$CO_2$ |
| n-$C_6F_{13}$ | $(CH_2)_2$ or —(CH=CH)—$CH_2$— | —O—$CH_2CH(OR^5)CH_2$—S— | $(CH_2)_{1-3}$ | —$CO_2$ |
| n-$C_6F_{13}$ | $(CH_2)_2$ or —(CH=CH)—$CH_2$— | —S—$CH_2CH(OR^5)CH_2$—$N(R^3)(R^4)$— | $(CH_2)_{1-3}$ | —$CO_2$ |
| n-$C_6F_{13}$ | $(CH_2)_2$ or —(CH=CH)—$CH_2$— | —S—$CH_2CH(OR^5)CH_2$—S— | $(CH_2)_{1-3}$ | —$CO_2$ |
| n-$C_6F_{13}$ | $(CH_2)_2$ or —(CH=CH)—$CH_2$— | —S—$CH_2CH(R^1)CON(R^2)$— | $(CH_2)_{1-3}N(R6)(R7)$—$(CH_2)_{2-3}$ | —$OSO_3^-$ |
| n-$C_6F_{13}$ | $(CH_2)_2$ or —(CH=CH)—$CH_2$— | —O—$CH_2CH_2$—$N(R^3)(R^4)$— | $(CH_2)_{1-3}N(R6)(R7)$—$(CH_2)_{2-3}$ | —$OSO_3^-$ |
| n-$C_6F_{13}$ | $(CH_2)_2$ or —(CH=CH)—$CH_2$— | —O—$CH_2CH(OR^5)CH_2$—$N(R^3)(R^4)$— | $(CH_2)_{1-3}N(R6)(R7)$—$(CH_2)_{2-3}$ | —$OSO_3^-$ |
| n-$C_6F_{13}$ | $(CH_2)_2$ or —(CH=CH)—$CH_2$— | —O—$CH_2CH(OR^5)CH_2$—S— | $(CH_2)_{1-3}N(R6)(R7)$—$(CH_2)_{2-3}$ | —$OSO_3^-$ |
| n-$C_6F_{13}$ | $(CH_2)_2$ or —(CH=CH)—$CH_2$— | —S—$CH_2CH(OR^5)CH_2$—$N(R^3)(R^4)$— | $(CH_2)_{1-3}N(R6)(R7)$—$(CH_2)_{2-3}$ | —$OSO_3^-$ |
| n-$C_6F_{13}$ | $(CH_2)_2$ or —(CH=CH)—$CH_2$— | —S—$CH_2CH(OR^5)CH_2$—S— | $(CH_2)_{1-3}N(R6)(R7)$—$(CH_2)_{2-3}$ | —$OSO_3^-$ |
| n-$C_6F_{13}$ | $(CH_2)_2$ or —(CH=CH)—$CH_2$— | —S—$CH_2CH(R^1)(CON(R^2)$— | $(CH_2)_{2-3}N(R6)(R7)$—$(CH_2)_{2-3}$ | —$SO_3^-$ |
| n-$C_6F_{13}$ | $(CH_2)_2$ or —(CH=CH)—$CH_2$— | —O—$CH_2CH_2$—$N(R^3)(R^4)$— | $(CH_2)_{2-3}N(R6)(R7)$—$(CH_2)_{2-3}$ | —$SO_3^-$ |
| n-$C_6F_{13}$ | $(CH_2)_2$ or —(CH=CH)—$CH_2$— | —O—$CH_2CH(OR^5)CH_2$—$N(R^3)(R^4)$— | $(CH_2)_{2-3}N(R6)(R7)$—$(CH_2)_{2-3}$ | —$SO_3^-$ |
| n-$C_6F_{13}$ | $(CH_2)_2$ or —(CH=CH)—$CH_2$— | —O—$CH_2CH(OR^5)CH_2$—S— | $(CH_2)_{2-3}N(R6)(R7)$—$(CH_2)_{2-3}$ | —$SO_3^-$ |

-continued

| $R_f$ | X | Y | L | Z |
|---|---|---|---|---|
| n-$C_6F_{13}$ | $(CH_2)_2$ or —(CH═CH)—$CH_2$— | —S—$CH_2CH(OR^5)CH_2$—$N(R^3)(R^4)$— | $(CH_2)_{2-3}N(R6)(R7)$—$(CH_2)_{2-3}$ | —$SO_3^-$ |
| n-$C_6F_{13}$ | $(CH_2)_2$ or —(CH═CH)—$CH_2$— | —S—$CH_2CH(OR^5)CH_2$—S— | $(CH_2)_{2-3}$-N(R6)(R7)—$(CH_2)_{2-3}$ | —$SO_3^-$ |
| n-$C_6F_{13}$ | $(CH_2)_2$ or —(CH═CH)—$CH_2$— | —S—$CH_2CH(R^1)CON(R^2)$— | $(CH_2)_{2-3}N(R6)(R7)$—$(CH_2)_{1-3}$ | —$CO_2^-$ |
| n-$C_6F_{13}$ | $(CH_2)_2$ or —(CH═CH)—$CH_2$— | —O—$CH_2CH_2$—$N(R^3)(R^4)$— | $(CH_2)_{2-3}N(R6)(R7)$—$(CH_2)_{1-3}$ | —$CO_2$ |
| n-$C_6F_{13}$ | $(CH_2)_2$ or —(CH═CH)—$CH_2$— | —O—$CH_2CH(OR^5)CH_2$—$N(R^3)(R^4)$— | $(CH_2)_{2-3}N(R6)(R7)$—$(CH_2)_{1-3}$ | —$CO_2$ |
| n-$C_6F_{13}$ | $(CH_2)_2$ or —(CH═CH)—$CH_2$— | —O—$CH_2CH(OR^5)CH_2$—S— | $(CH_2)_{2-3}N(R6)(R7)$—$(CH_2)_{1-3}$ | —$CO_2$ |
| n-$C_6F_{13}$ | $(CH_2)_2$ or —(CH═CH)—$CH_2$— | —S—$CH_2CH(OR^5)CH_2$—$N(R^3)(R^4)$— | $(CH_2)_{2-3}N(R6)(R7)$—$(CH_2)_{1-3}$ | —$CO_2$ |
| n-$C_6F_{13}$ | $(CH_2)_2$ or —(CH═CH)—$CH_2$— | —S—$CH_2CH(OR^5)CH_2$—S— | $(CH_2)_{2-3}N(R6)(R7)$—$(CH_2)_{1-3}$ | —$CO_2$ |

Specific examples of compounds of Formula I include, but are not limited to compounds (a)-(j):

(a)

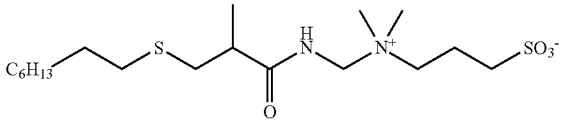

(b)

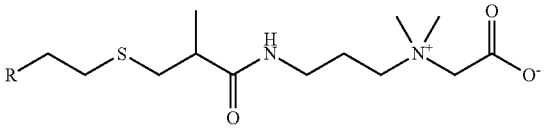

R = $C_6F_{13}$ (c)

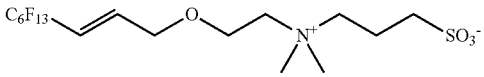

(d)

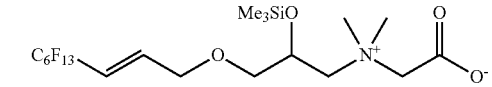

(e)

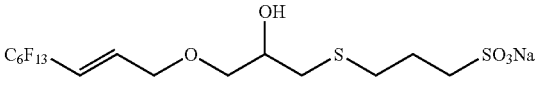

(f)

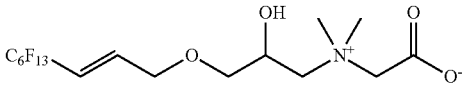

(g)

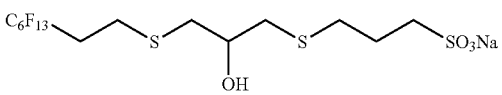

(h)

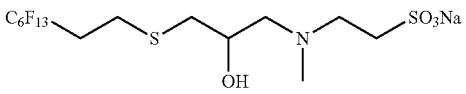

(i)

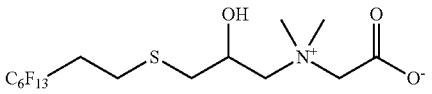

-continued (j)

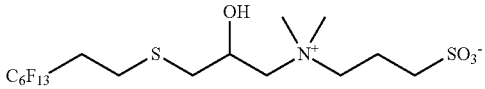

The skilled artisan will recognize that more than one perfluoroalkyl surfactant of formula I may be used when preparing the AFFF concentrate. Typically the surfactant or mixture of surfactants of formula I is present in an amount of about 0.5% to about 20% by weight.

In particular embodiments of the concentrate, the non-fluorinated surfactant may be an anionic surfactant. Suitable anionic surfactants include compounds well known in the art, for example: medium to long chain alkyl sulfates, alkyl ether sulfates, alkyl sulfonates, fatty acid salts such as decyl sulfate, alkyl phosphates and the like.

The composition also may contain one or more foam stabilizing agents. Such agents are well known in the art and include glycol ethers, including diethylene glycol ethers (carbitols), such as butyl carbitol. The foam stabilizing agent is present in an amount of about 1% to about 50%.

The composition also may contain one or more corrosion inhibitors that minimize corrosion in storage vessels and piping in which the concentrates might be stored over extended periods. Suitable corrosion inhibitors are well known in the art, and include compounds such as tolyltriazole. The corrosion inhibitor typically is present at the minimum concentration (–about 0-2%) required to inhibit corrosion to the desired extent, although higher concentrations can be used.

The composition may also contain an alkylpolyglycoside surfactant. Suitable alkylpolyglycosides include those described in U.S. Pat. No. 4,999,119, which is hereby incorporated by reference in its entirety. The alkylpolyglycoside typically is present in an amount of about 0.3 to about 7%.

The composition advantageously contains a high molecular weight water-soluble polymer, such as a polysaccharide gum. When an AFFF containing such a gum is applied to a fire fueled by a hydrophilic liquid, the gum precipitates on contact with the hydrophilic liquid and forms a protective layer, known as a gelatinous mat, which impedes the breakdown of the foam. The gum typically is present in an amount of about 0.1 to about 5%.

In a specific embodiment of the composition, the foam stabilizing agent is present in an amount of 1-50%, the non-fluorinated surfactant is present in an amount of 0.1 to 30% and the perfluoroalkyl surfactant or mixture of surfactants of formula I is present in an amount of 0.5 to 20%.

Also provided are fire-fighting foams, containing a composition as described above, and an aqueous liquid. Typically the aqueous liquid is water. In specific embodiments, the aqueous liquid may be brackish water or seawater.

The compositions as described above may be used in methods of making a fire-fighting foam, where the composition is foamed with an aqueous liquid, for example water. In specific embodiments, the aqueous liquid may be brackish water or seawater.

Preparation of Molecules of Formula I

The molecules of Formula I can be prepared by methods that are well known in the art. For example, compounds such as (a) and (b) (compounds where Y in Formula I is —S—$CH_2CH(R^1)CON(R^2)$—) that contain an amide bearing a fluorocarbon-containing thioether substituted at the 3 position may readily be prepared by Michael addition of the thiol to a suitable acrylamide. The acrylamide precursor may be prepared by nucleophilic ring opening of a sultone. Methods of preparing such molecules are described in inter alia, U.S. Pat. No. 4,098,811. Suitable reaction schemes for preparing compounds (a) and (b) are:

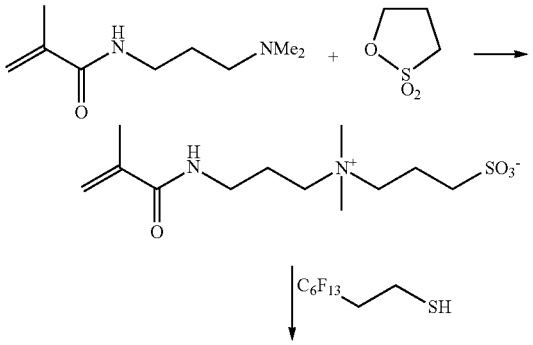

-continued

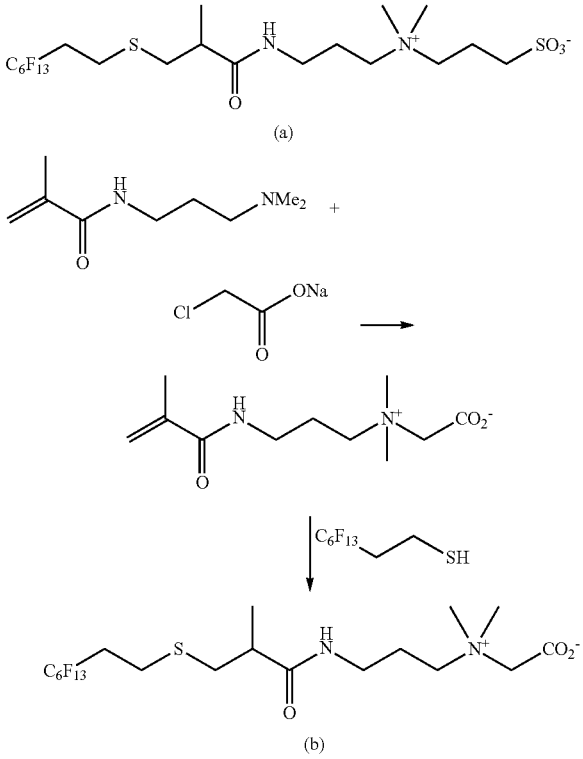

Compounds such as (c)-(f) where the perfluoro moiety is appended to a double bond may conveniently be prepared using an addition-elimination of a perfluoroalkyl iodide to an unsaturated compound using a radical initiator such as Rongalite ($HOCH_2SO_2Na$), as illustrated schematically below:

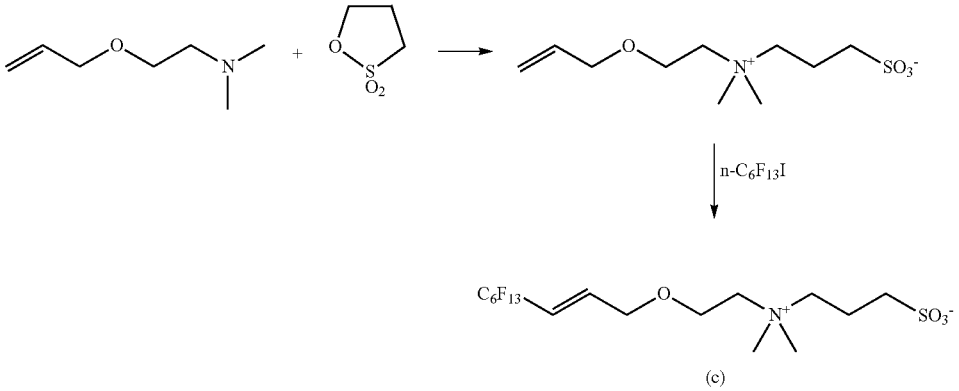

***

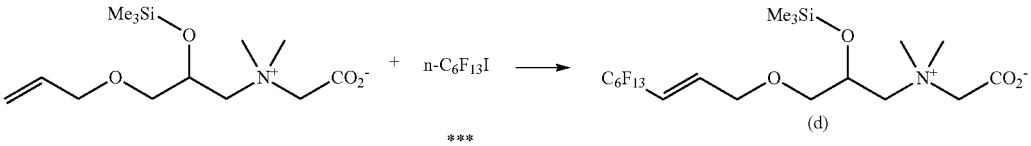

***

-continued
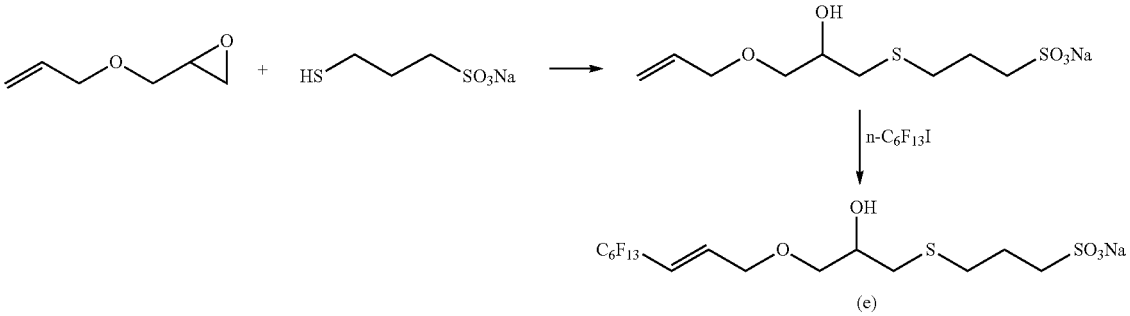
***
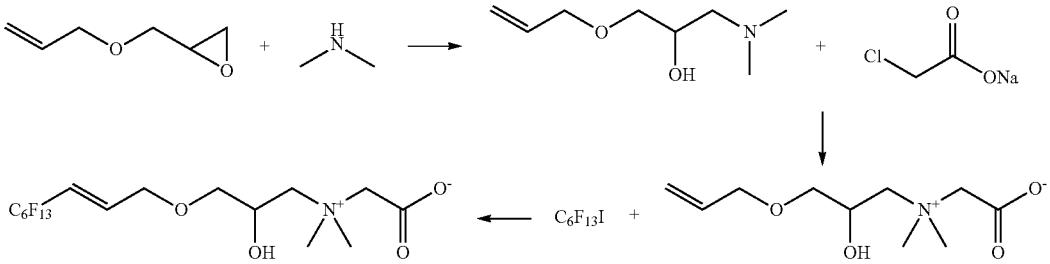
***
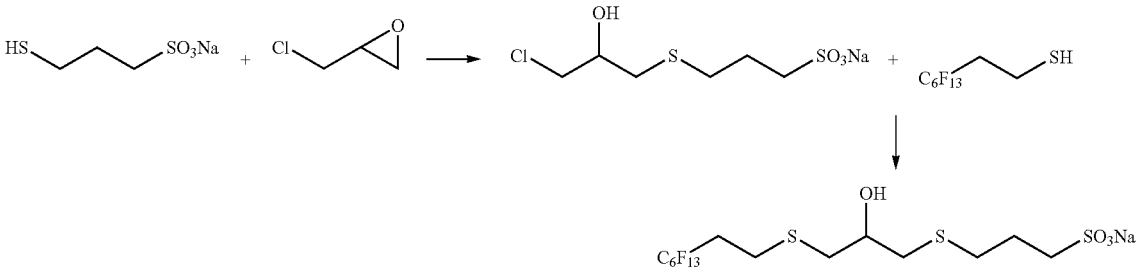
***
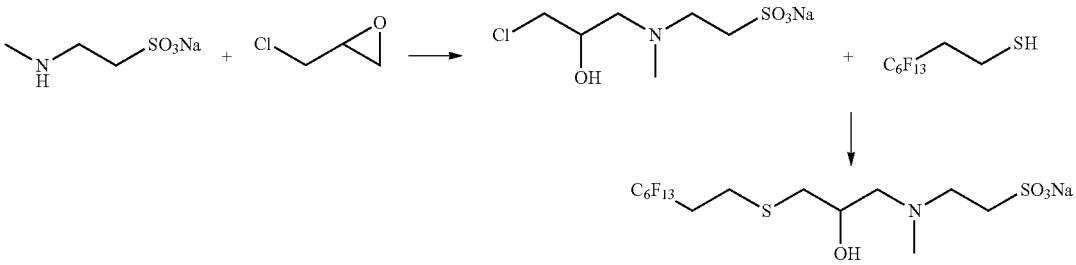
***
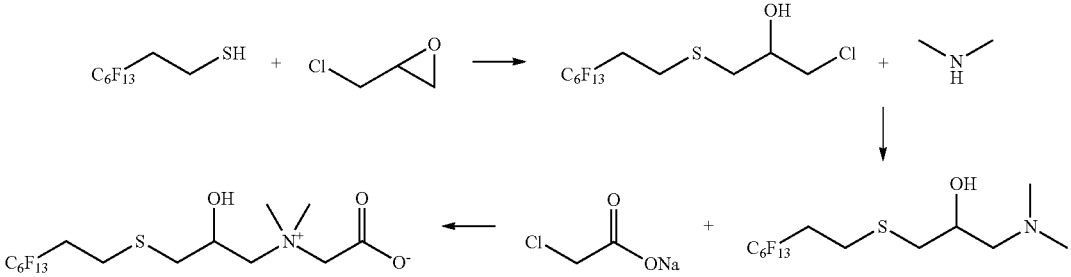
***

-continued

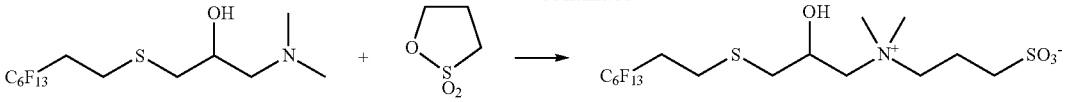

(Prepared as above) (j)

***

Molecules such as (g)-(j) may also be prepared by nucleophilic ring opening reactions of epoxides with, for example, thiols or amines, to produce hydroxyl compounds that can be further elaborated using methods that are well known in the art.

Advantageously, the composition does not contain an effective amount of a perfluorinated surfactant that does not conform to formula I, although in certain embodiments, the composition may contain an effective amount of a fluorinated foam stabilizing agent containing 3 to 7 perfluorinated carbon atoms.

Specific details of exemplary methods of preparing these compounds are provided in the Examples below.

Preparation and Use of AFFF Concentrates

The components listed above were mixed to prepare an aqueous film forming foam concentrate. This concentrate may then be mixed with water, typically as a 3% solution, and foamed using foaming devices well known in the art.

The concentrate, upon dilution with water and aeration, produces an aqueous film-forming foam which is applied to a body of flammable liquid such as a spill or pool which is burning or subject to ignition. The foam extinguishes the burning liquid, and prevents further ignition by providing a blanket to cover the fuel surface and excluding air. Film-forming foam compositions such as those described herein are particularly desirable for extinguishing fires involving flammable fuels, such as gasoline, naphtha, diesel oils, hydraulic fluids, petroleum and other hydrocarbons, and also may be used for extinguishing fires involving polar solvent (including acetone, ethanol, and the like) by addition of suitable high molecular polymers such as xanthan gums, as described above and also as described in U.S. Pat. Nos. 4,536,298 and 5,218,021.

The concentrates which when diluted with water and aerated produce a low density air-foam which quickly spreads on the surface of a body of hydrocarbon fuel, or other flammable liquid forming a blanket over the fuel or liquid. As the foam (on the surface of the flammable liquid) drains, a film is formed which, if disturbed or broken, tends to reform to seal off hot vapor emanating from the flammable liquid, thus extinguishing the fire. Although hydrocarbon surfactants may form a foam blanket, the flammable liquid vapors may wick through the foam and reignite. Foams comprising fluorosurfactants reduce the ability of the flammable liquid from wicking through the film and thereby prevent reignition.

As water under pressure passes through a fire hose, typically 3 percent by volume of the concentrate composition is inducted into the hose line by the Venturi effect to form a remixture (or "premix") of the concentrate diluted with water. The premix becomes aerated to produce a foam by use of an air-aspirating nozzle located at the outlet end of the hose. Equipment which can be used to produce and apply these aqueous air-foams are known in the art and also are described in publications by the National Fire Protection Association.

Preferably, the compositions are introduced into a fire or flame in an amount sufficient to extinguish the fire or flame. One skilled in the art will recognize that the amount of extinguishing composition needed to extinguish a particular hazard will depend upon the nature and extent of the hazard.

The following examples are offered to illustrate, but not to limit, the claimed invention.

EXAMPLES

Example 1

A. Preparation of 3-(methacrylamido)propyl dimethyl betaine

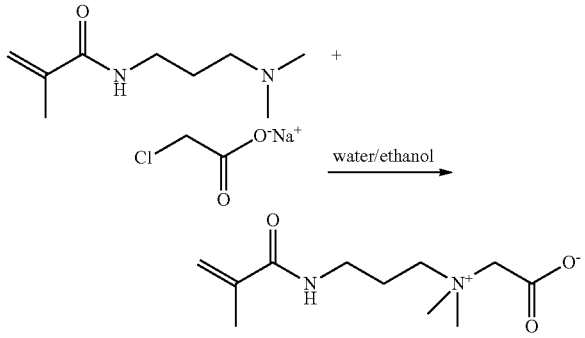

To a 2 L of round bottom flask was added 258 g (1.50 mol) of N-[3-(dimethylamino)propyl]-methacrylamide (Aldrich, 99%), 190 g (1.60 mol) of sodium chloroacetate, 1200 g of ethanol and 60 g of water. The reaction mixture was stirred under reflux for 2 days, during which a solution of 3 g of NaOH in 6 ml of water was added periodically to maintain the pH of the reaction solution around 8~9. When reaction was complete, the NaCl formed during the reaction was substantially removed by filtering the reaction mixture at 60~70 C. The filtrate was evaporated to dryness and the crude product was used directly in the next reaction step without further purification, assuming that reaction had gone to completion.

B. Preparation of N-(Carboxymethyl)-N,N-dimethyl-3-{[1-oxo-2-methyl-3-[{3,3,4,4,5,5,6,6,7,7,8,8,8-tridecafluorooctyl}thio]propyl]amino}-1-propanium, inner salt

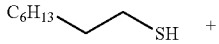

-continued

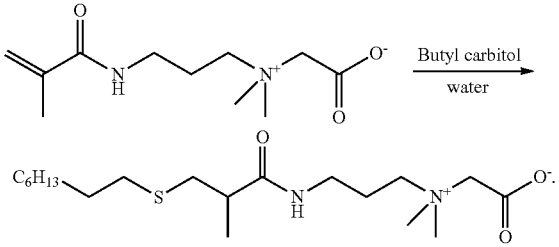

To a 2 L of round bottom flask was added 308 g (1.35 mol) of 3-(methacrylamido)propyl dimethyl betaine, 490 g (1.29 mol) of 1H,1H,2H,2H-perfluorooctane thiol, 1000 g of $H_2O$ and 250 g of butyl carbitol. ~1.0 g of NaOH were added to adjust the pH of the reaction solution to 8~9. The mixture was stirred at 80~85 C for 14~16 hours until all of the thiol was consumed. The clear reaction solution was cooled to room temperature to gave 2100 g of solution containing 15.32 wt % of Fluorine, 12 wt % of butyl carbitol and 40 wt % of solid content.

Example 2

A. Preparation of [(N,N-dimethyl)-allyloxyethylamino]-propyl sulfobetaine

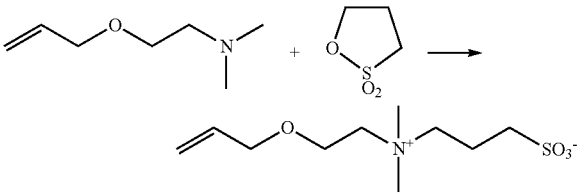

A mixture of allyl-2-(N,N-dimethylamino)ethyl ether (11.88 g, 0.1 mol) and butyl glycol (40 ml) was heated to 60° C., and 1,3-propane sultone (11.56 g, 0.102 mol) was added dropwise to the mixture. The mixture was stirred for 1 hour at 60° C., and a further 4 hours at 105° to 110° C. Water (2.0 ml) was added to the mixture while cooling to 90° C., and the resulting mixture was stirred at 95° C. for 2 hours to destroy the excess sultone. Water (35 ml) was added and the mixture shaken for 1 minute and allowed to stand for 15 min. The mixture was extracted with ether and the water layer was evaporated to dryness under vacuum. The crude product was purified by column chromatography, eluting with methanol/methyl acetate, providing the product 1 (16.8 g, 72.75%) as a yellowish transparent viscous liquid which crystallized as needle-like crystals on standing at room temperature for 3 days.

B. Preparation of N-(propylsulfonate)-N,N-dimethyl-2-[{(2E/Z)-4,4,5,5,6,6,7,7,8,8,9,9,9-tridecafluoro-2-nonen-1-yl}oxy]ethylamino]-1-propanium, inner salt

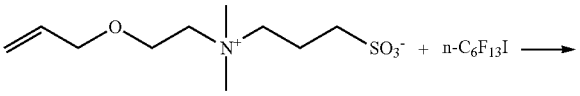

-continued

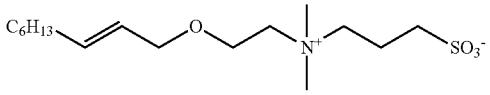

Perfluoro n-hexyl iodide (n-$C_6F_{13}I$, 17.84 g, 0.04 mol) and $HOCH_2SO_2Na$ (0.31 g, 0.002 mol) were shaken until the purple color of iodine disappeared, after which 10.25 g (0.0408 mol) of product 1 (3.36 g, (0.04 mol) $NaHCO_3$, (3.36 g, 0.04 mol), water (40 ml) and ethanol (40 ml) were added. The mixture then was stirred at 75-80° C. for 4 hours. Sodium hydroxide (1.6 g, 0.04 mol) in 10 ml of water was added and the clear reaction mixture turned dark brown. After 2 hours stirring at 70~75° C. the reaction was allowed to stand overnight at room temperature. The crude product (24 g) was obtained after filtration and removal of solvent in vacuo. Recrystallization from ethanol provided the purified product (9 g, 40%) as a brownish solid.

Example 3: Preparation of N-(Carboxymethyl)-N,N-dimethyl-3-[{(2E/Z)-4,4,5,5,6,6,7,7,8,8,9,9,9-tridecafluoro-2-nonen-1-yl}oxy]2-(trimethylsiloxy) propylamino]-1-propanium, inner salt

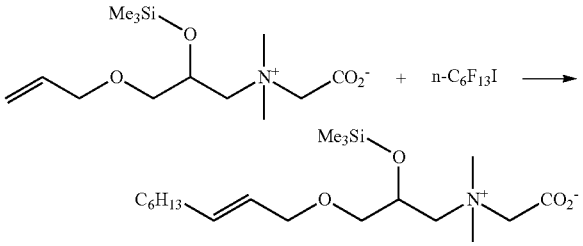

Perfluoro n-hexyl iodide (n-$C_6F_{15}I$, 14.72 g, 0.033 mol) and Rongalite ($HOCH_2SO_2Na$, 0.254 g, 0.00165 mol) were shaken until the purple color of iodine disappeared, after which 9.83 g (0.034 mol) of product 2, $NaHCO_3$, (2.77 g, 0.033 mol), water (50 ml) and ethanol (50 ml) were added. The mixture then was stirred at 75-80° C. for 4 hours. Sodium hydroxide (1.32 g, 0.033 mol) in 10 ml of water was added and the clear reaction mixture turned dark brown. After 2 hours stirring at 70~75° C. the reaction was allowed to stand overnight at room temperature. The crude product (23 g) was obtained after filtration and removal of solvent in vacuo. After column chromatography 17 g (0.028 mol) of a yellowish solid were obtained in 84.8% isolated yield.

Example 4

A: Preparation of 3-[2-propen-1-yl]oxy-2-(hydroxy) propylthio]-propylsulfonate ether

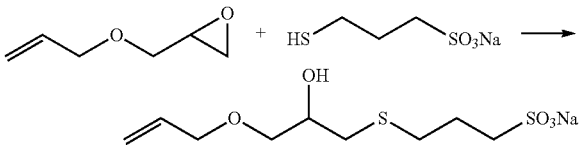

To a mixture of 3-mercaptopropanesulfonic acid, sodium salt (103 g, 0.52 mol) and 800 g of $H_2O$ was added 0.9 g of NaOH to adjust the solution pH to 8~9. 58.8 g (0.51 mol) of ethyl glycidyl ether was added at room temp. over 0.5 hr and the resulting mixture a then stirred at 65-75° C. overnight, after which sodium bicarbonate (43 g, 0.5 mol) was added. This reaction mixture was carried on crude.

B: Preparation of 3-[{(2E/Z)-4,4,5,5,6,6,7,7,8,8,9,9,9-tridecafluoro-2-nonen-1-yl}oxy]2-(hydroxy)propylthio]propylsulfonate ether

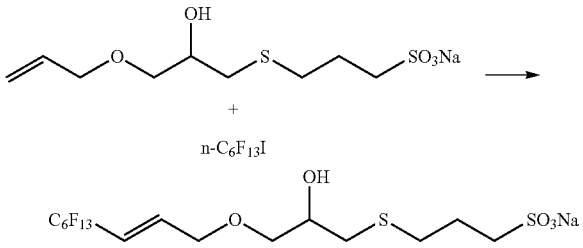

Rongalite (0.8 g, 0.005 mol) and 34.6 g (0.1 mol) of n-$C_6F_{13}I$ were shaken until colorless and then added to the crude reaction mixture. The mixture then was stirred at 75~80° C. for 4 hrs. An additional 20 g of n-$C_6F_{13}I$ was added until the solution became clear. NaOH ((4.0 g, 0.1 mol) was added, followed by stirring at 70° C. for 2 h. Solvent was removed in vacuo and the resulting product dried in a 60° C. oven. The product was recrystallized from ethanol/water to provide 45 g of a yellowish solid (88% yield.).

Example 5: 3: Formulations and Test Results

A stock solution was prepared using butyl carbitol (18.9% wt), lauryl dipropionate (4.0% wt), decyl sulfate (1.6% wt), tolytriazole (0.02% wt), and water (75.48% wt). Table 1 describes the preparation of the AFFF concentrate using the specific compounds of Formula I. For comparison purposes, two analogs of compound (b) shown above also were prepared by the method exemplified in Example 1B. These compounds are described as compounds (k) (R=$C_8F_{17}$) and (l) (R=$C_4F_9$), respectively, in Table 2 below. All concentrates made were based on fluorine content and the calculated weights of fluorosurfactants were adjusted for purity.

TABLE 1

Lab Preparation of Fire Fighting foam Concentrates

| Compound | MW | % F | Charge wt (g) | Stock Solution (g) | Water (g) |
|---|---|---|---|---|---|
| (a) | 672 | 37% | 0.87 | 27 | 2.13 |
| (b) | 608 | 16% | 1.95 | 27 | 1.05 |
| (c) | 569 | 43% | 0.73 | 27 | 2.27 |
| (d) | 607 | 41% | 0.78 | 27 | 2.22 |
| (e) | 610 | 11% | 2.79 | 27 | 0.21 |
| (f) | 535 | 46% | 0.69 | 27 | 2.31 |
| (g) | 600 | 36% | 0.89 | 27 | 2.11 |
| (h) | 597 | 39% | 0.82 | 27 | 2.18 |
| (i) | 539 | 20% | 1.59 | 27 | 1.41 |
| (j) | 604 | 41% | 0.78 | 27 | 2.22 |

The ensuing concentrates were diluted into 97 parts synthetic sea water to form a premix, charged to a premix holding tank, and the tank was pressurized to 10 psi using compressed air. A 1 square foot test pan was filled with 500 mL of water and 500 mL of heptane, ignited and allowed to burn for 10 seconds. Foam was generated through an air-aspirated nozzle and then applied to the heptane fire for a maximum of 60 seconds. Extinguishment times (Ext) were recorded and then a small burn back cup was placed in the center of the fire test pan. The fuel in the cup was ignited and the time it took the fire to cover 100% of the pan was recorded as burn back resistance (BB). The specific compounds of Formula I were compared based on extinguishment and burn back resistance.

Foam quality was determined by placing 100 mL of premix into a blender and mixed at the lowest setting for 1 minute. The foam generated from the blender was poured into a 1000 mL graduated cylinder and the volume recorded. Foam expansion was calculated by dividing the recorded volume by the starting volume. The quarter drain time was recorded as the time needed for 25 mL of liquid to collect at the bottom of the graduated cylinder. The following table lists the results.

TABLE 2

Fire Test Results and Foam Quality Measurements

| Compound | Ext. (sec) | BB (min:sec) | EX (ratio) | 25% DT (min:sec) | 50% DT (min:sec) |
|---|---|---|---|---|---|
| A | 45 | 15:22 | 7 | 6:43 | 9:33 |
| B | 44 | 20:09 | 6.2 | 6:18 | 9:44 |
| C | 43 | 16:42 | 7.2 | 4:50 | 8:21 |
| D | 26 | 12:24 | 5.2 | 4:50 | 7:07 |
| E | 31 | 12:12 | 7.3 | 5:09 | 7:57 |
| F | 25 | 14:07 | 6.5 | 6:20 | 9:14 |
| G | 42 | 21:00 | 5.1 | 4:34 | 6:54 |
| H | 23 | 17:00 | 5.5 | 5:30 | 8:59 |
| I | 30 | 12:27 | 6.6 | 6:16 | 10:09 |
| J | 17 | >30:00 | 7.1 | 6:43 | 10:20 |
| K | 24 | >30:00 | 6.0 | 9:05 | 11:57 |
| L | DNE | NA | 5.4 | 4:40 | 7:03 |

DNE—Did not extinguish

Compounds (a)-(j) performed as well as the commercially available product AFC-5A. The commercially available product can contain $C_8$ homologues and fluorostabilizers. It has been found that removing both $C_8$ homologues and the fluorostabilizers adversely affects the products fire performance. Compounds (a)-(j) were tested as standalone fluorosurfactants and the initial fire test results indicated that compounds such as those shown in the table can be used as a substitute for both anionic and amphoteric fluorinated surfactants and as a fluorostabilizer replacement. Full scale fire testing has shown that compound (a)-(j) can be used at a significantly reducted fluorine content and still meet third party approval criteria, such as applicable Underwriter's Laboratory, US and UK military specifications, and corresponding standards set forth by the European Union.

The testing also showed that the compositions maintained their performance in brackish water and sea water, which is difficult to accomplish with the existing commercially available materials.

Fire performance results for the Military Fire Test F-24385 on regular gasoline further demonstrated that compounds (a)-(j) can replace an anionic fluorosurfactant and a fluorostabilizer with an overall 25% reduction in fluorine. Testing showed that a formulation lacking a conventional fluorostabilizer could still meet the test specifications. Conventional fluorostabilizers are typically used to improve burnback resistance and increase the longevity of a foam product. The ability of foam compositions as described herein to meet the requirements of the Military Fire Test in the absence of a conventional fluorostabilizer was very unexpected.

The Military Fire Test also requires that the fire fighting foam products be tested at a wide range of proportioning percentages to ensure that a weak or rich proportioned product can still meets the fire test requirements. Even proportioned at half strength with reduced active components the formulation described above met the test requirements.

Further testing on this composition on the UL Sprinkler Fire Test with a reduced fluorine loading gave excellent results based on the degree of difficulty associated with the water deluge specification of the sprinkler test. Even at a 25% reduction in fluorine the composition met both the extinguishment and burn back requirements of the UL Sprinkler Fire Test.

We claim:

1. An aqueous film-firefighting composition concentrate comprising:

(a) an effective amount of a monomeric $C_6$ perfluoroalkyl surfactant having a structure represented by the formula I:

$$R_f—X—Y-L-Z \qquad I:$$

wherein $R_f$ is $C_6$ straight or branched chain perfluoroalkyl;

X is $C_2$-$C_{12}$ straight or branched chain alkylene, or $C_2$-$C_{12}$ straight or branched chain alkenylene containing 1 or 2 alkene moieties;

Y is selected from the group consisting of: $—S—CH_2CH(R^1)CON(R^2)—$, $—O—CH_2CH_2—N(R^3)(R^4)—$; $—O—CH_2CH(OR^5)CH_2—N(R^3)(R^4)—$; $—O—CH_2CH(OR^5)CH_2—S—$; $—S—CH_2CH(OR^5)CH_2—N(R^3)(R^4)—$; and $—S—CH_2CH(OR^5)CH_2—S—$;

L is $C_2$-$C_{12}$ straight or branched chain alkylene, where one carbon atom in the chain optionally is replaced by $—N(R^6)(R^7)—$; and Z is $—OSO_3^-$, $—SO_3^-$, or $—CO_2^-$, wherein $R^1$, $R^2$, $R^3$, $R^4$, $R^6$ and $R^7$, independently are H or straight or branched chain $C_1$-$C_6$ alkyl, and $R^5$ is H or straight or branched chain $C_1$-$C_6$ alkyl or trialkylsilyl;

(b) an effective amount of a foam stabilizing agent, and (c) an effective amount of at least one non-fluorinated surfactant, wherein said composition has less than 0.8% F, and is substantially free of any surfactant containing a perfluoroalkyl group containing more than 6 carbon atoms and wherein said composition meets Military Specification MIL-F-24385F.

2. The composition according to claim 1 wherein said non-fluorinated surfactant is an anionic surfactant.

3. The composition according to claim 1, wherein said foam stabilizing agent is a glycol ether.

4. The composition according to claim 1, further comprising a corrosion inhibitor.

5. The aqueous film-firefighting composition concentrate according to claim 1, wherein said composition does not contain an effective amount of a perfluorinated surfactant that does not conform to formula I.

6. The composition according to claim 1, wherein Y is $—S—CH_2C(R^1)CON(R^2)—$.

7. The composition according to claim 6, wherein $R^1$ is H or straight chain alkyl and $R^2$ is H.

8. The composition according to claim 1, wherein Y is $—O—CH_2CH_2—N(R^3)(R^4)—$.

9. The composition according to claim 8, wherein $R^3$ and $R^4$ are H or methyl.

10. The composition according to claim 1, wherein Y is $—O—CH_2CH(OR^5)CH_2—N(R^3)(R^4)—$.

11. The composition according to claim 10, wherein $R^3$ and $R^4$ are H or methyl, and $R^5$ is H or trialkylsilyl.

12. The composition according to claim 1, wherein Y is $—O—CH_2CH(OR^5)CH_2—S—$.

13. The composition according to claim 12, wherein $R^5$ is H or trialkylsilyl.

14. The composition according to claim 1, wherein Y is $—S—CH_2CH(OR^5)CH_2—N(R^3)(R^4)—$.

15. The composition according to claim 14, wherein $R^3$ and $R^4$ are H or methyl, and $R^5$ is H or trialkylsilyl.

16. The composition according to claim 1, wherein Y is $—S—CH_2CH(OR^5)CH_2—S—$.

17. The composition according to claim 16, wherein $R^5$ is H or trialkylsilyl.

18. The composition according to claim 1 or claim 5, further comprising an alkylpolyglycoside in the amount of 0.3 to 7%.

19. The composition according to claim 1 or claim 5, further comprising a polysaccharide gum in an amount of 0.1 to 5%.

20. The composition according to claim 5, comprising a plurality of perfluoroalkyl surfactants of the formula I.

21. The composition according to claim 1 or claim 5, wherein said foam stabilizing agent is present in an amount of 1-50%, said non-fluorinated surfactant is present in an amount of 0.1 to 30% and said perfluoroalkyl surfactant or mixture of surfactants of formula I is present in an amount of 0.5 to 20%.

22. A fire-fighting foam, comprising a composition according to claim 1 or claim 5, and an aqueous liquid.

23. The foam according to claim 22, wherein said aqueous liquid is brackish water or seawater.

24. A method of making a fire-fighting foam, comprising foaming a composition according to claim 1 or claim 5 with an aqueous liquid.

25. The method according to claim 24, wherein said aqueous liquid is brackish water or seawater.

* * * * *